United States Patent [19]

Bigun et al.

[11] 4,034,666

[45] July 12, 1977

[54] CRANK PRESS

[76] Inventors: Oleg Pavlovich Bigun, ulitsa Juzhno-Moravskaya, 56, kv. 27; Grigory Matveevich Rodov, ulitsa 3 Internatsionala, 9, kv. 25, both of Voronezh, U.S.S.R.

[21] Appl. No.: 638,908

[22] Filed: Dec. 8, 1975

[51] Int. Cl.[2] ..... B30B 1/14; B30B 1/16

[52] U.S. Cl. ..... 100/231; 100/259; 100/272; 100/281

[58] Field of Search ..... 100/231, 272, 280, 281, 100/259; 83/630, 634, 639

[56] References Cited

U.S. PATENT DOCUMENTS

| | | | |
|---|---|---|---|
| 463,160 | 11/1891 | Moore et al. | 100/272 X |
| 1,737,563 | 12/1929 | Boschert | 100/272 X |
| 2,633,094 | 3/1953 | Muller | 100/272 X |
| 3,115,086 | 12/1963 | Stimmel | 100/259 X |

*Primary Examiner*—Charles E. Phillips
*Attorney, Agent, or Firm*—Lackenbach, Lilling & Siegel

[57] ABSTRACT

The crank press comprises a frame with a bed for accommodating the workpiece and with guides mounted on said frame perpendicularly to the bed surface, said guides supporting a slide which carries the working tool and being connected with the crankshaft by a kinematic chain comprising an engaging mechanism for starting the slide on its working stroke, said mechanism being made in the form of a power cylinder.

3 Claims, 5 Drawing Figures

CRANK PRESS

The present invention relates to power presses and more particularly it relates to crank presses.

The invention will be used most successfully in single-crank presses, such as for example, the open-back type.

Known in the art are crank presses whose frame has a bed for accommodating the workpiece and mounts guides arranged perpendicularly to the bed surface, said guides supporting a slide which carries the working tool and being connected with the frame-mounted crankshaft by a kinematic chain comprising a mechanism for engaging the working stroke of the slide.

In the crank press of this type the kinematic linkage of the crankshaft with the slide comprises a pitman linkage articulated to the crankshaft and a lever articulated to the slide.

The slide is sent on its working stroke by a mechanism comprising a lever, one end of which is connected by a hinge to said pitman linkage and said lever, while its other end is articulated to a rod which is capable of reciprocating in the direction perpendicular to the slide axis, one end of said rod being slanted and interacts with a wedge which is moved by an independent drive parallel to the slide axis.

In this layout the slide is started on its working stroke by fixing the rod with the wedge, and stopped by releasing said rod.

Such a layout incorporating a large number of elements and their connections causes a high inertia of the engaging mechanism which increases the time for starting and stopping the working stroke of the slide and reduces the maximum permissible number of continuous and single strokes of the slide and the efficiency of the press as a whole.

The large number of elements and their connections working at high speeds, as well as high inertia forces, impairs the reliability of the press and makes it more expensive.

An object of the present invention is to eliminate the aforesaid disadvantages.

The main object of the invention is to provide a crank press with a slide engaging mechanism which would have a small number of component elements, and still ensure high reliablity of the press, improve its service characteristics and rule out overloading.

This object is accomplished by providing a crank press wherein the frame incorporates a bed for accommodating the workpiece and mounts guides arranged perpendicularly to the bed surface, said guides supporting a slide which carries the working tool and being connected with a frame-mounted crankshaft by a kinematic chain comprising a slide engaging mechanism according to the invention, said engaging mechanism is constituted by a power cylinder whose movable element is included into said kinematic chain whereas its fixed element is articulated to the frame with a provision for reciprocating axially in the direction perpendicular to the slide axis at the moment when overloading forces are imposed on said slide.

It is expedient that the power cylinder should be a single acting cylinder with a return spring.

According to the invention, the kinematic chain incorporates a pitman linkage articulated to the crankshaft, the free end of said pitman linkage being articulated with a lever, which is also articulated to the slide, and with the movable element of the cylinder.

According to one of the embodiments of the invention, the fixed element of the power cylinder is mounted on the frame with the air of a plate-type shock absorber rigidly fastened to the frame and consisting of a body in the form of a sleeve with a cover, said body accommodating a rod installed along the body axis and provided with plate springs located between its shoulder and said cover, the ends of the rod passing through the holes in the body cover and bottom while the end with the shoulder is articulated to the fixed element of the power cylinder.

Such a solution has made it possible to reduce considerably the number of elements of the slide engaging mechanism and, consequently, to decrease the time required for starting and stopping said slide and to increase the number of continuous and single strokes of the slide thereby stepping up the efficiency of the press as a whole.

The reduced number of elements of the slide engaging mechanism diminishes the inertia forces originating in the elements of said mechanism and the wear in the connections of said elements whereby the life of the press as a whole is extended.

Fastening of the power cylinder to the frame with the aid of a shock absorber prevents the inception of overloading forces on the slide during operation.

The design of the power cylinder prevents its movable element from interacting with said spring while the slide pauses in the topmost position which eliminates the losses of power for compressing said spring. The design of the shock absorber enables it to take considerably strong forces in spite of its small size. , Now the invention will be described in detail by way of example with reference to the accompanying drawings in which.

Figure 1:
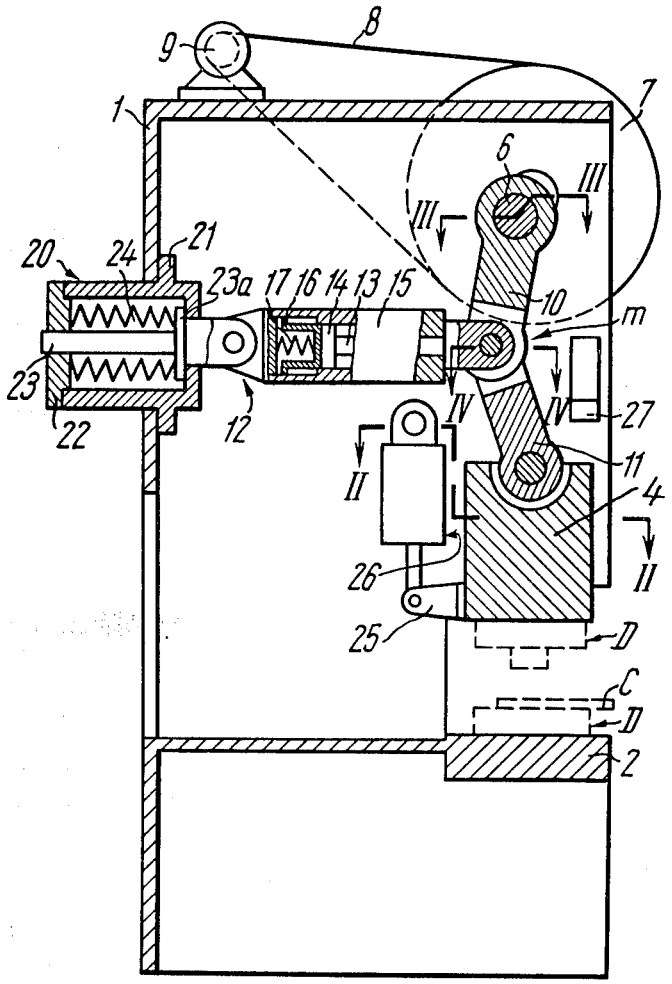
FIG. 1 is a schematic longitudinal section through the crank press.
Figure 3:
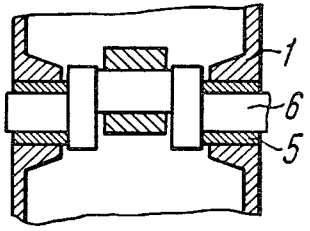
Figure 5:
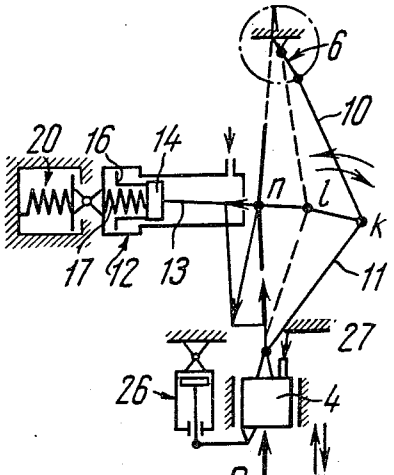
Figure 4:
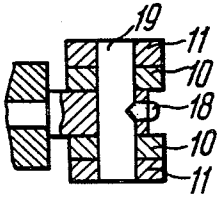
Figure 2:
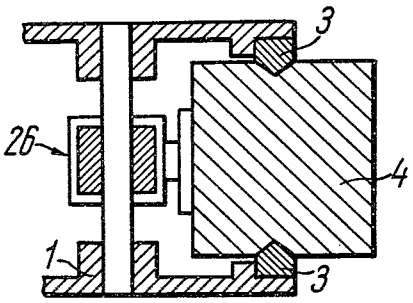
FIG. 2 is a cross sectional view taken along line 11—11 in FIG. 1.

FIG . 3 is a cross sectional view taken along line 111—111 in FIG. 1;

FIG. 4 is a cross sectional view taken along line IV—Iv in FIG. 1;

FIG. 5 is a schematic representation of the kinematic chain connecting the crankshaft with the slide. , The crank press comprises a frame 1 (FIG. 1) which incorporates a bed 2 for accommodating the workpiece "C" and mounts guides 3 (FIG. 2) arranged perpendicularly to the surface of the bed 2, said guides supporting a slide 4.

The lower part of the working tool "D" is secured on the bed 2 (FIG. 1) and the upper part is fastened to the slide 4.

Mounted in bearing 5 in the upper part of the frame 1 is a crankshaft 6 carrying a flywheel 7 driven by an electric motor 9 via a belt transmission 8.

The electric motor 9 is rigidly fixed on the frame 1.

The crankshaft 6 is kinematically linked with the slide 4.

This linkage is preferably effected with the aid of a pitman linkage 10 articulated to the crankshaft 6, said pitman linkage being articulated to the lever 11 which, in turn, is articulated to the slide 4.

The kinematic chain linking the slide 4 with the crankshaft 6 also comprises a mechanism for engaging the working stroke of the slide 4. This mechanism is constituted by a single-acting power cylinder 12.

The power cylinder has a movable element, i.e., a rod 13 with a piston 14 which is accommodated in the fixed element, i.e., a body 15 of the cylinder 12; installed between the body bottom and piston 14 is a sleeve 16 with a spring 17 inside.

The sleeve 16 has a shoulder entering a recess on the inner surface of the body of the cylinder 12, the width of said recess being equal to the compression length of the spring 17, taking into account the height of the shoulder of the sleeve 16.

The rod 13 of the cylinder 12 is fastened by a setting screw 18 (FIG. 4) on the pivot 19 of the hinge connecting the pitman linkage 10 with the lever 11.

The body 15 (FIG. 1) of the cylinder 12 is articulated to the frame 1 so that its axis is essentially perpendicular to the slide 4.

Installed coaxially with said cylinder 12 is a shock absorber 20 whose body 21 is rigidly fixed to the frame 1 and closed with a cover 22.

A rod 23 with a shoulder 23*a* passes through the coaxial holes in the body 21 and cover 22.

Located on the rod 23 between said shoulder 23*a* and cover 22 are plate springs 24.

One end of the rod is articulated to the body 15 of the cylinder 12.

A bracket 25 rigidly fixed to the slide 4 is articulated with a counterbalance 26 of any known design suitable for this purpose, said counterbalancer being articulated to the frame 1.

A stop 27 fastened rigidly to the frame limits the uppermost position of the slide 4.

The crank press functions as follows.

The electric motor 9 is started and sets the flywheel 7 and crankshaft 6 in rotation via a belt transmission 8; the crankshaft imparts swinging motion to the pitman linkage 10 and to the lever 11 articulated to said pitman linkage 10.

The hinge *m* (FIG. 5) oscillates between points K and L.

Meanwhile, the slide 4 is held in the uppermost position by the counterbalancer 26, which acts permanently on the slide, and by the stop 27.

To start the slide 4 on its working stroke, the underpiston space of the cylinder 12 is filled with working fluid.

Being acted upon by the working fluid, the piston 14 comes to the extreme left position, displacing the sleeve 16 and compressing the spring 17. The rod 13 will move the hinge *m* to point *n*.

At this moment the crankshaft 6 will move the pitman linkage 10 and lever 11 to the lower position and, inasmuch as the hinge *m* is pulled to the extreme left position (point *n*), the force of the crankshaft 6 will be transmitted via the above-mentioned kinematic chain to the slide 4 which will move down a distance equal to twice the eccentricity of the crankshaft 6. This will complete the working stroke of the slide 4. The kinematic chain (FIG. 5) linking the slide 4 with the crankshaft 6 is so designed that on the completion of the working stroke the power cylinder 12 is subjected to approximately 15% of the force on the slide. If the slide is subjected to a stronger force than the rated (nominal) limit, the slide 4 will stop short of its downmost position. The cylinder 12 will move to the left through a distance equal to the deformation of the shock absorber 20 and the crank of the crankshaft 6 will pass its downmost position without loading the slide 4 in excess of the permissible limit. During further rotation of the crankshaft 6 the shock absorber 20 will come to its initial position.

To withdraw the slide 4 from its working position, the working fluid is discharged from the underpiston space of the cylinder 12. The spring 17 acts via the sleeve 16 on the piston 14 whose rod 13 will move the hinge *m* to the intermediate (nonworking) position (point 6). The slide 4 is lifted by the counterbalancer 26 to the stop 27 and is fixed in the uppermost position.

We claim:

1. A crank press including a tool comprising a frame with a bed for a work piece, guides mounted on said frame generally perpendicular to the surface of said bed, a slide disposed within said guides for translational movement and carrying said tool for moving same from a non-working position to a working position, a crankshaft mounted on said frame, a pair of toggle links pivotably connected at one end about a common axis and one of said pair having its other end pivotably connected to said crankshaft while the other of said pair having its other end pivotably connected to said slide; a fluid power cylinder having a moveable piston member pivotably connected at said common axis to said pair of toggle links, shock-absorbing means fixed to said frame and including a spring-loaded rod element disposed in the shock absorber, said cylinder being pivotably mounted to said shock-absorbing means which is fixedly mounted on said frame and said cylinder being disposed generally perpendicular to the axis of said slide, a compression spring urging said piston to permit the withdrawal of said slide from the working position upon release of fluid pressure acting on said piston.

2. The crank press according to claim 1, wherein said fluid power cylinder is single-acting and said compression spring is disposed between said piston and an end of said cylinder.

3. The crank press according to claim 1, including counterbalancing means attached to said slide for constantly urging said slide to the non-working position.

* * * * *